US006164383A

United States Patent [19]

Thomas

[11] Patent Number: 6,164,383

[45] Date of Patent: Dec. 26, 2000

[54] FIRE EXTINGUISHING SYSTEM FOR AUTOMOTIVE VEHICLES

[76] Inventor: Orrett H. Thomas, 115-87 230th St., Cambria Heights, N.Y. 11411-1421

[21] Appl. No.: 09/375,945

[22] Filed: Aug. 17, 1999

[51] Int. Cl.[7] ..... A62C 37/10

[52] U.S. Cl. ..... 169/61; 169/62; 169/26

[58] Field of Search ..... 169/62, 60, 61, 169/56, 19, 20, 26; 137/102

[56] References Cited

U.S. PATENT DOCUMENTS

| | | | |
|---|---|---|---|
| 3,630,288 | 12/1971 | Tiberti . | |
| 3,762,479 | 10/1973 | Fike, Sr. et al. . | |
| 3,788,666 | 1/1974 | Kramer et al. . | |
| 3,915,237 | 10/1975 | Rozniecki | 169/62 |
| 3,967,255 | 6/1976 | Oliver et al. | 169/61 |
| 3,986,560 | 10/1976 | Heath et al. . | |
| 3,993,138 | 11/1976 | Stevens et al. | 169/62 |
| 4,110,812 | 8/1978 | Arutunian et al. | 169/62 |
| 5,578,828 | 11/1996 | Brown et al. . | |
| 5,590,718 | 1/1997 | Bertossi | 169/62 |
| 5,613,564 | 3/1997 | Rhines | 169/61 |
| 5,651,416 | 7/1997 | Clauson | 169/62 |
| 5,659,133 | 8/1997 | Sims et al. . | |
| 5,670,784 | 9/1997 | Cusack et al. . | |
| 5,763,888 | 6/1998 | Glasheen et al. . | |
| 5,826,664 | 10/1998 | Richardson | 169/62 |
| 5,828,797 | 10/1998 | Minott et al. . | |
| 5,899,275 | 5/1999 | Okamoto | 169/20 |
| 5,918,681 | 7/1999 | Thomas . | |
| 5,960,888 | 10/1999 | Moore, Sr. | 169/61 |

*Primary Examiner*—Andres Kashnikow
*Assistant Examiner*—Dinh Q. Nguyen
*Attorney, Agent, or Firm*—Dilworth & Barrese

[57] ABSTRACT

A fire extinguishing system for vehicles homes and offices includes a firing assembly for attachment to a container of fire extinguishing agent, a firing pin for penetrating the container to release the fire extinguishing agent, the firing pin being moved by an explosive squib or a solenoid, a conduit for carrying fire extinguishing agent to a discharge outlet, and a control system having a capacitor for pulse discharge of electric power to the control head to fire the squib or solenoid. The control box includes a three-position switch for firing the system, putting the system on automatic function, or deactivating the system. Other switches can include sensors for activating the firing pin in response to high temperature, or vehicle impact. One or more optical flame sensors are employed with pulse counting electronic circuitry. Also included herein is an electropneumatic firing assembly employing a movable piston valve.

20 Claims, 7 Drawing Sheets

FIRE EXTINGUISHING SYSTEM FOR AUTOMOTIVE VEHICLES

BACKGROUND

1. Field of the Invention

This invention relates to fire extinguishers, and particularly to fire extinguishers for automobiles.

2. Background of the Art

Automobile fires cause a great deal of harm and can result in injury or death to the vehicle occupants as well as damage to the vehicle itself. Such fires can result from impact during a collision, or even while the automobile is stationary. It is important for the occupants to have the opportunity to leave the automobile and seek help. Time is of the essence in such circumstances for the vehicle occupants to escape injury, especially since the fuel tank can contain several gallons of volatile and highly flammable gasoline. Accordingly, a device which extinguishes, or even just temporarily suppresses, an automobile fire can make an important contribution to vehicle safety.

What is needed is a fire extinguishing system for vehicles which warns the occupants of a vehicle of a fire and automatically extinguishes or suppresses the fire.

SUMMARY

A fire extinguishing system is provided herein which comprises:

a) a firing assembly for mounting to a container of pressurized fire extinguishing agent having an outlet with a puncturable seal, the firing assembly including:
   a housing having an interior space,
   a slidable member positioned in the interior of the housing and movable between a proximal position and a distal position for puncturing the seal,
   firing means responsive to an electric current for moving the slidable member;

b) an optical flame detector for generating a signal in response to the receiving of radiation of a flame; and c) a control system for supplying the electric current to the firing means, the control system being responsive to the signal of the optical flame detector and having a manual control switch.

The firing means can, for example, include an explosive squib or a solenoid for advancing the firing pin in response to an electric pulse. Also included herein is an electropneumatic system for the release of the fire extinguishing agent.

DETAILED DESCRIPTION OF PREFERRED EMBODIMENTS

The present invention employs a fire extinguishing agent which can be discharged through fire resistant ducts and nozzles, for example, into the engine compartment of a vehicle and/or the fuel tank area, or any other area suitable for the use of a fire extinguisher. While the fire extinguishing system described herein is particularly suitable for use in vehicles, such as automobiles, it is also within the scope of the present invention to employ the present system in houses, offices, and other areas where fire protection is desired.

Figure 1:
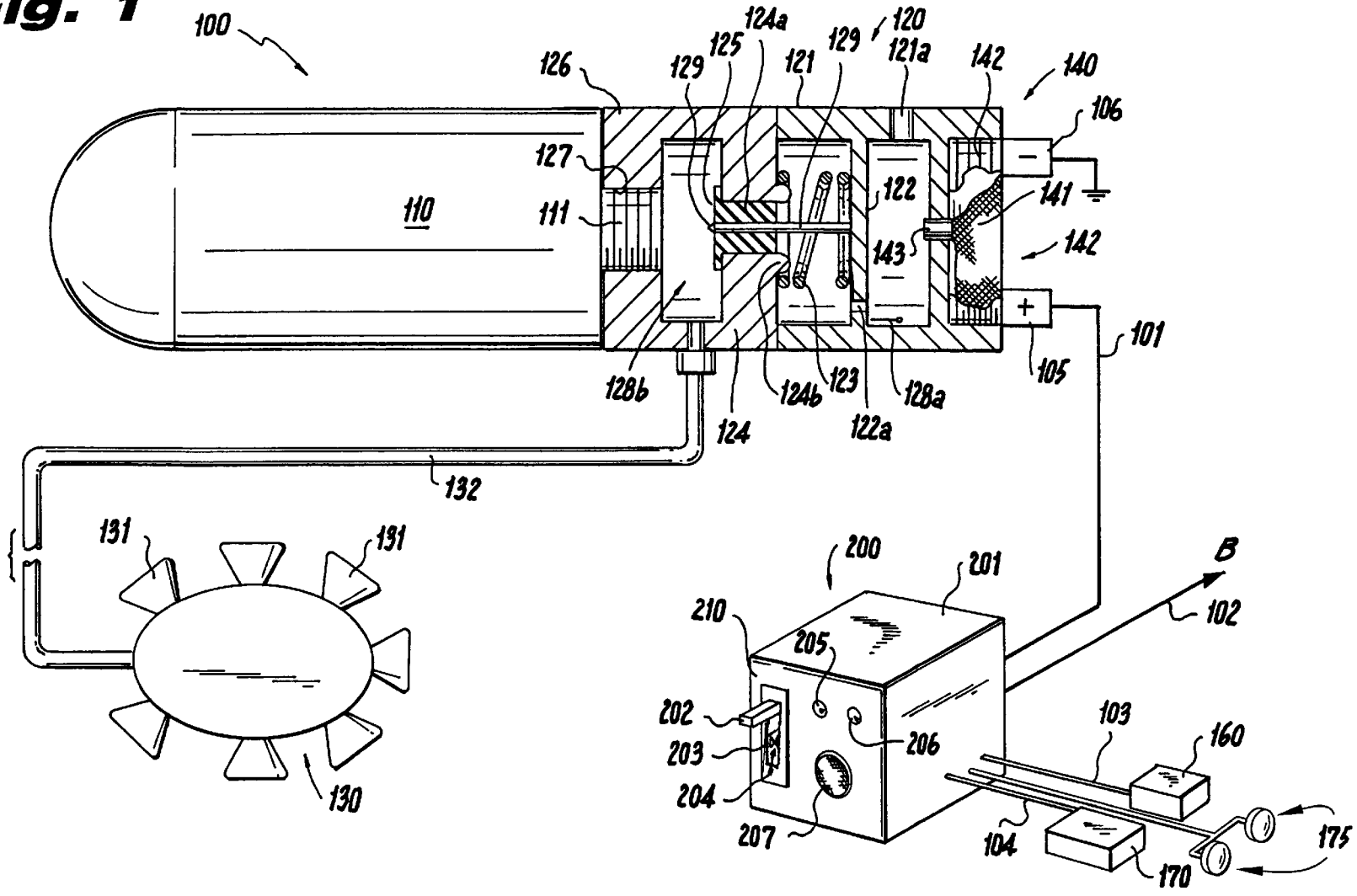
FIG. 1 is a diagrammatic illustration of an embodiment of the invention employing a squib firing system for driving a piston.

Referring now to FIG. 1, an embodiment 100 of the fire extinguishing system is illustrated wherein the fire extinguishing agent, and optionally a propellant, is contained under pressure in cylinder or cartridge 110. The cartridge can be fabricated from, for example, ferrous or nonferrous alloys, aluminum, high strength plastic, or combinations thereof. The fire extinguishing agent can be, for example, a powder ABC fire extinguishing agent, a halohydrocarbon such as bromotrichloromethane or bromochlorodifluoromethane, a gas such as nitrogen or carbon dioxide, or other suitable agent for extinguishing or suppressing combustion. Fire agent cartridge 110 includes a proximal sealed outlet portion 111 which is penetrable by a firing pin to release the fire extinguishing agent. The fire agent cartridge 110 is connected to the firing assembly 120 by, for example, screw type mounting as shown, or by a bayonet type mounting.

Firing assembly 120 includes a preferably cylindrical housing 121. A vent aperture 121*a* in the housing wall permits the escape of excess gas from the interior of the housing. Preferably, the firing assembly includes a pressure gauge and/or safety vent to release at least some fire extinguishing agent and/or propellant in the event of excessive buildup of internal pressure. A retainer plate 124 fixedly mounted within the housing 121 divides the interior of the housing into first and second chambers 128*a* and 128*b*, respectively.

Figure 2:
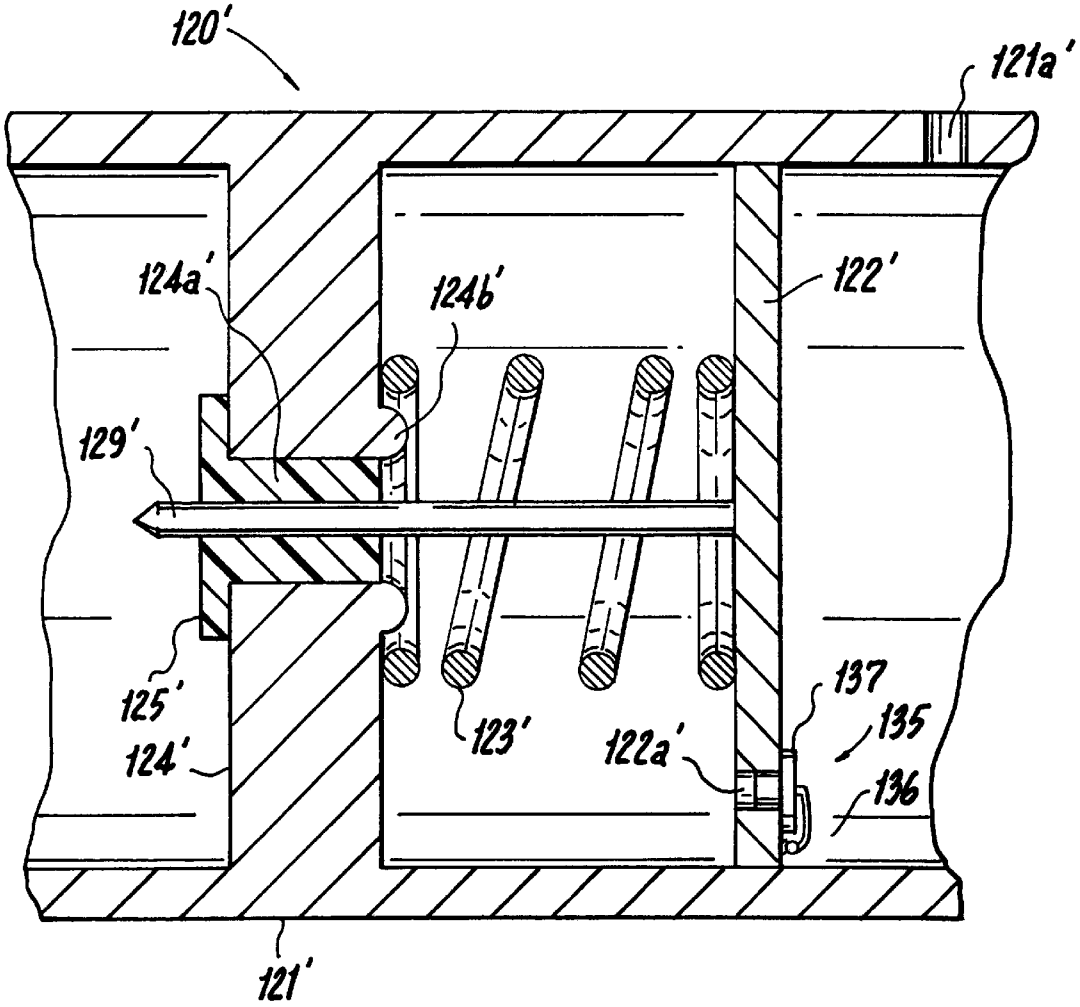
FIG. 2 is a side view of an alternative embodiment of the piston of FIG. 1.

Piston plate 122 is slidably mounted within the first chamber 128*a* and is biased by helical compression spring 123 to a proximal position. Spring 123 is mounted between retainer plate 124 and piston plate 122. Annular ridge 124*b* extends around the periphery of aperture 124*a* in the retainer plate and helps to maintain the position and alignment of spring 123. Piston plate 122 includes a vent aperture 122*a* which has a diameter ranging from about 1/32" to about 1/8", preferably about 1/16". The vent aperture 122*a* permits passage of gas through the piston plate 122 to avoid excessive buildup of pressure between the piston plate 122 and retainer plate 124. Alternatively, as shown in FIG. 2 piston plate 122' can optionally include a check valve 135 to permit passage of gas in only a proximal direction through aperture 122*a'*. Check valve 135 can, for example, be a stopper 137 hingedly mounted at hinge 136 and biased by a spring to a closed position covering the proximal end of aperture 122*a'*. As shown in FIG. 2, firing assembly 120' includes a spring 123' corresponding to spring 123 above. The retainer plate 124' has an aperture 124*a'* corresponding to aperture 124*a* and an annular ridge 124*b'* corresponding to annular ridge 124*b*. Bushing 125' corresponds to bushing 125 described below. Firing pin 129' corresponds to firing pin 129 discussed below. Upon distal movement of piston plate 122' when the squib is fired and/or buildup of excess gas pressure in the space between piston plate 122' and retainer plate 124', gas flows proximally through aperture 122*a'* and overcomes the biasing force of the check valve spring to enter the first chamber. Thereafter, the excess gas can exit through vent aperture 121*a'*. Various other type check valves known in the art may alternatively be used.

Referring again to FIG. 1, a firing pin 129 projects distally from the piston plate along the axis of firing assembly 120.

Bushing 125 is fabricated from a metal or rubber member and is mounted within aperture 124*a* in retainer plate 124. The firing pin 129 extends through an axial aperture in bushing 125. Bushing 125 is configured to sufficiently close tolerances with respect to firing pin 129 and aperture 124*a* to provide a gaseous seal.

A distal mounting plate 126 provides means for mounting the cartridge 110 to the firing assembly 120. Threaded aperture 127 in the mounting plate is adapted to removably engage sealed outlet portion 111 of the cartridge 110. Alternatively, the sealed outlet portion 111 can engage aperture 127 with a bayonet type mounting.

A squib assembly 140 provides propelling means and includes a safety housing 142 attached by a threaded screw type engagement to housing 121. The safety housing 142 encloses an electrically fired explosive squib 141. An opening 143 directs gases from the exploding squib into chamber 128*a*. When the squib 141 is activated piston plate 122 is propelled distally by the explosive gases released into first chamber 128*a*. Firing pin 129 then punctures the sealed outlet portion 111 of the fire agent cylinder 110, thereby releasing fire extinguishing agent and/or propellant into second chamber 128*b*. From there the gases are conveyed via duct 132 to a discharge chamber 130 which is positioned where the fire is to be suppressed, for example, in the engine compartment of the vehicle, the fuel tank area, or any other selected area wherein fire suppression may be desired. The fire extinguishing agent exits the discharge chamber 130 via one or more nozzles 131 to extinguish or suppress the fire.

In one embodiment, control of the fire extinguishing system is provided by a control system 200, which includes a housing 201, indicator lights 205 and 206, three-position switch 210, and audible alarm 207. Switch 210 includes a handle 202 slidably disposed in slot 203 and movable into any of three positions. In a first upward position the control system is on "stand-by" or automatic status and the system will activate the firing assembly 120 when impact sensor 160 or temperature sensor 170 or optical sensors 175 detect a collision or fire. Optionally, two or more impact sensors 160 or temperature sensors 170 may be used. In a middle second position of switch handle 202 the control system is in an "off" status. The control system will not operate nor will the squib assembly 140 be fired while the control system 200 is in the "off" status. In the third bottom position of switch handle 202 the control system is manually activated and the propelling means 140 is fired. Preferably, slot 203 through which switch handle 202 is disposed includes means to prevent the switch handle from inadvertently being moved to the third position. For example, slot 203 can include detents 204 which project into the slot. The detents 204 can be manually retracted to permit passage of the switch handle to the third position. Alternatively, the detents 204 can be resiliently moved to permit passage of the switch handle only upon application by the user of a predetermined amount of manual force which is greater than that normally sufficient to move the switch. This helps to ensure that movement of the switch handle 202 into the manual position is intended and not accidental.

The control system 200 is powered by a battery B (for example, the vehicle battery) to which the system is electrically connected by line 102. Line 101 carries an electric current to positive terminal 105 of the squib. The negative terminal 106 is connected to ground. The control system is preferably connected to impact sensor 160 by line 103, to temperature sensor 170 by line 104, and to at least one, and preferably two or more, optical sensors 175.

Impact sensor 160 is a switching mechanism which activates in response to a vehicle collision. An impact switch suitable for use in the present invention is commercially available, for example from All Electronics Corp., and Herbach and Rademan Company.

Temperature sensor 170 is a switching mechanism which activates in response to heat generated by a fire. A temperature sensor suitable for use in the present invention is available from H&R Electric Co.

The fire extinguishing system further includes at least one, and preferably two or more optical flame sensors 175, which detect the presence of a flame for activating the fire extinguishing system. Various types of optical flame sensors are known and commercially available. A preferred optical flame sensor is commercially available from various sources such as Hamamatsu Photonics K.K. of Hamamatsu, Japan. The flame sensor employs a photoelectric UV detector with a spectral response in the 185–260 nm range, and a suitable driving circuit. The detector is sensitive to the UV radiation emitted by flames, but not by sunlight, fluorescent or tungsten light. The detector is commercially available from various sources such as Hamamatsu Photonics Company from which the detector is available under the designation UVtron OR2868. Various electronic circuits may be employed to drive the optical flame sensor. A preferred driving circuit for the UVtron detector is also commercially available from various sources such as Hamamatsu Photonics K.K. under the designation C3704. The optical flame sensors 175 are positioned in the vehicle where flames are most likely to occur. Optionally, the optical flame sensors 175 can be encased, or potted, in plastic to prevent damage thereto from shock and excessive G-forces in the event of a vehicle collision.

The optical sensors 175 are capable of detecting the presence of a flame. The preferred optical sensors are responsive to ultraviolet (UV) radiation emission below 300 nanometer wavelength. More preferably the optical sensor is responsive to UV radiation in the 180–280 nm wavelength range and most preferably in the 185 to 260 nm wavelength range. An optical sensor system having a suitable spectral response to UV radiation is commercially available from various sources such as Hamamatsu K.K. of Hamamatsu, Japan. Particularly, a preferred U.V. sensor system employs the Hamamatsu UVtron® 2868 flame sensor and the Hamamatsu UVtron® driving circuit C3704. The Uvtron® system typically emits a pulsed signal with the frequency of the pulses corresponding to the intensity of the received UV signal in the spectral response range of the flame sensor, as described more fully below.

Figure 3:
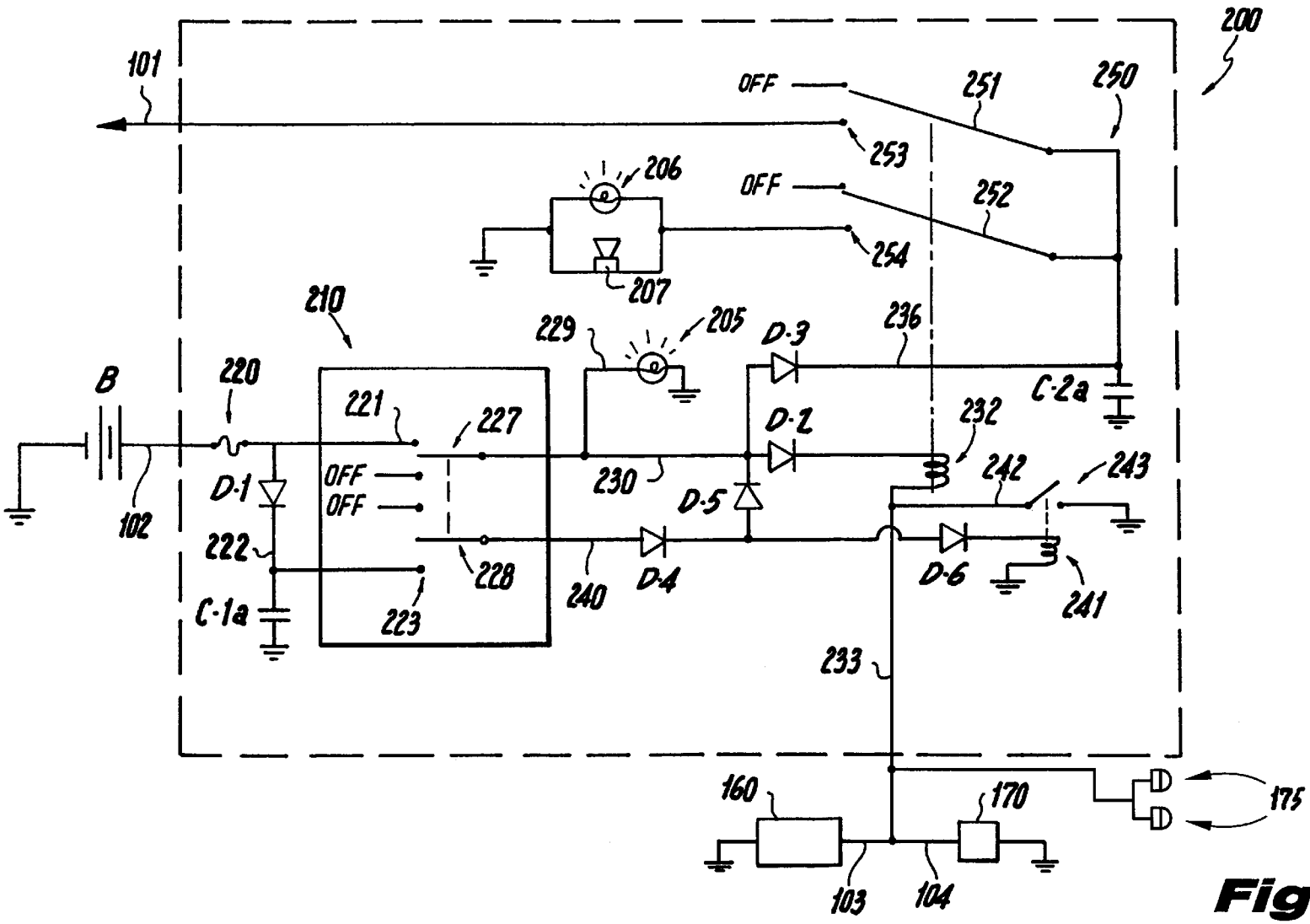
FIG. 3 is a diagram of the electric circuitry of the control system.

Referring now to FIG. 3, in one embodiment the circuitry of control assembly 200 is shown wherein C-1*a* and C-2*a* are current storage devices, optionally capacitors, which are preferably capable of storing energy of a quarter to a half of a joule at a potential of the level of about 12 to 24 volts and also preferably having very low leakage so that the charge can be stored for a long period of time. Alternatively, current storage devices C-1*a* and/or C-2*a* can be rechargeable batteries of 12 to 24 volts. Rectifier diodes D-1, D-2, D-3, D-4, D-5, and D-6 are selected so as to accommodate the voltage and current requirements of the system. Battery B is preferably a 12-volt rechargeable automobile battery.

More specifically, line 102 conveys current from battery B to the control assembly 200. A circuit breaker or fuse 220 protects the circuitry of control assembly 200 from current surges.

Line 222 conveys a current through diode D-1 to current storage device (capacitor or battery) C-1*a* which remains in a charged state until discharged by movement of switch 210 into a manual firing third position, as discussed below.

Switch 210 is a double-pole three-position switch. In the middle or "off" position poles 227 and 228 are not in contact with any switch terminals. In a first "stand-by" or automatic position, pole 227 contacts terminal 221 and line 230 becomes electrified. Pole 228 contacts the "off" terminal in the first "automatic" position. Line 229 carries current to indicator light 205 which provides visual confirmation that the system is electrically active and in the automatic setting. Also, in the stand-by condition current storage devices C-1*a* and C-2*a* are charged. In the event of a collision and/or fire, one or more of optical sensors 175, impact sensor switches 160 and temperature sensor switches 170 will close, thereby establishing a signal to close relay 250. Current will then flow through line 230, through diode D-2, and through the coil of relay 232. Upon activation of relay 232 the double-pole relay switch 250 closes. Poles 251 and 252 of relay switch 250 are resiliently biased to an initial "off" position. Upon closure of relay switch 250, poles 251 and 252 move to a second, "on" position in which pole 251 contacts terminal 253 and pole 252 contacts terminal 254. Current will then flow through diode D-3 and line 236, and will be conveyed to line 101 via pole 251. Line 101 conveys the current to the squib assembly 140 (or solenoid 190 in the embodiment discussed below), whereupon the system is fired (or solenoid 190 activated) and the fire extinguishing agent is released. Current is also conveyed from terminal 254 to indicator light 206 and audible alarm 207. The audible alarm can be, for example, a buzzer, horn, or bell. Also, upon closure of relay switch 250, current storage device C-2*a* will discharge through line 236 and into switch 250. This discharge provides a pulse of current which facilitates the firing of the system, for example, in the event the battery B is weak or otherwise unable to provide sufficient current.

In the "manual" third position pole 227 is moved to an "off" terminal. Pole 228 moves into contact with terminal 223. Current then flows through line 240 through diodes D-4 and D-6, and through the coil of relay 241 which then closes relay switch 243, thereby establishing a ground. Current then also flows through diodes D-5 and D-2, and through the coil of relay 232, thereby closing switch 250. As discussed above, current then flows through diode D-3 and line 236. Capacitor C-1 supplements the current flow with a pulse of discharge current to facilitate firing of the system. Optionally, capacitor C-1 can be replaced by a rechargeable battery supplying sufficient current and voltage to fire the system.

Figure 5:
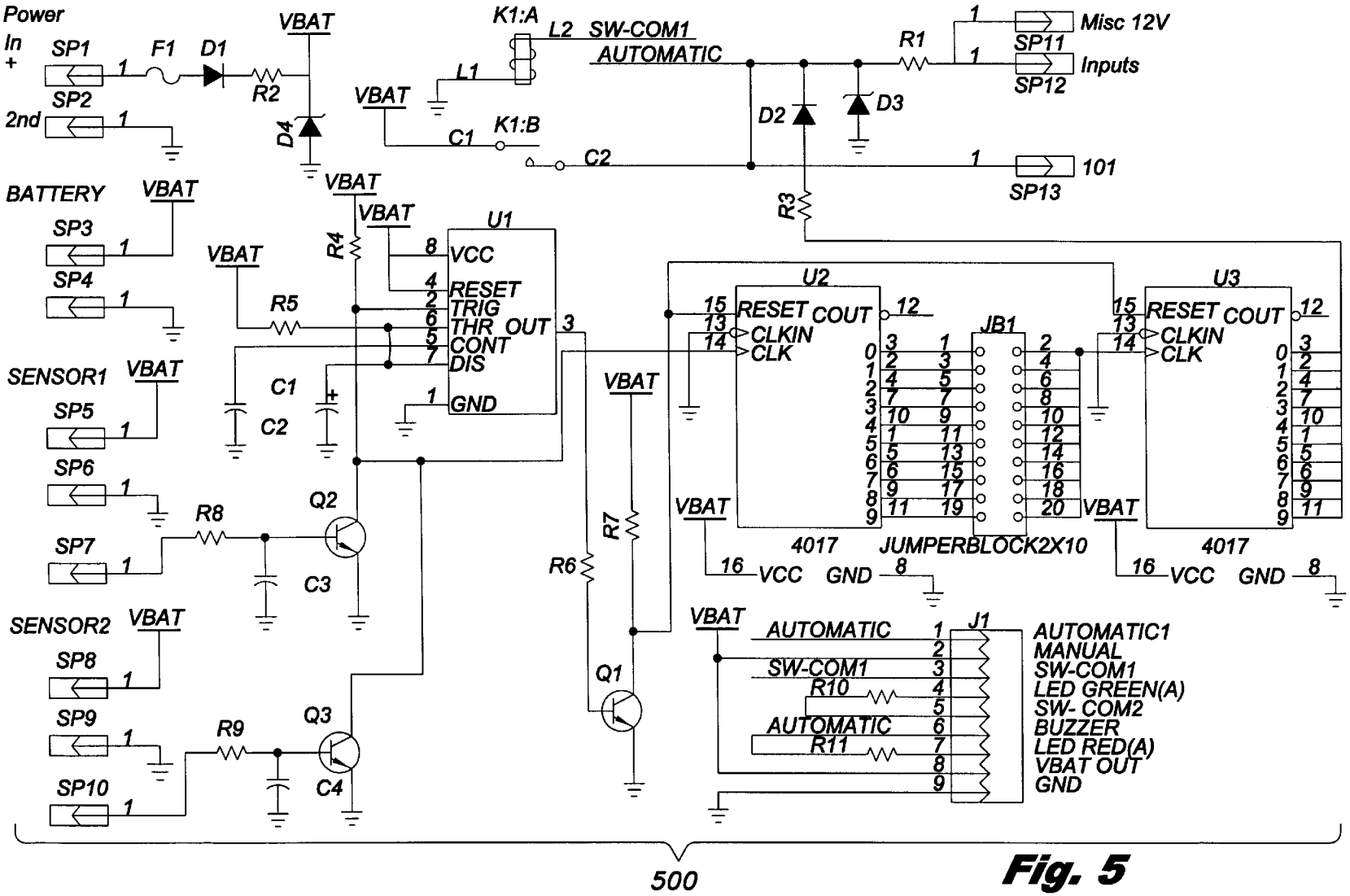
FIG. 5 is a diagram of an alternative electric circuit for the control system.

Another embodiment of the circuitry of the control assembly 200 is shown in FIG. 5. The control circuitry 500 of this embodiment can be used in conjunction with impact sensors or temperature sensors, but is particularly suited for use in conjunction with optical flame sensors which produce a pulsed output signal, such as the UVtron® system.

The driving circuit for the optical sensor will typically contain a power supply for supplying power to the optical sensor, and a signal processing circuit for receiving signals from the optical sensor and for detecting and cancelling errors received due to background discharges, such as cosmic rays or scattered sunlight. The driving circuit further provides a pulsed driver output signal to the control circuitry 500 shown in FIG. 5.

Referring to FIG. 5, a sensor/driving circuit combination is shown as SP5, SP6 and SP7. Pulse input SP7 receives a pulsed driver output signal containing a plurality of pulses, from the driving circuit. Power is supplied to the driving circuit via SP5 and SP6, being plus voltage and ground, respectively. Similarly, a second sensor/driving circuit combination may be connected at SP8, SP9, and SP10, being plus voltage, ground, and pulse input, respectively.

Power is applied to the control circuit 500 on SP1 and SP2, which are plus voltage and ground, respectively. In the present embodiment, the plus voltage source is preferably a 12 volt car battery. However, it should be appreciated that other power supply means may be employed in alternative embodiments. The plus voltage supplied from SP1 is switched through the relay contacts K1:B of relay K1 when relay coil K1:A is energized, thereby closing contacts K1:B and allowing current to flow to a firing output SP13 which is connected to the squib assembly 142 (FIG. 1), thereby actuating the system and releasing the extinguishing agent. Fuse F1, serially connected to the plus DC voltage SP1, protects the relay contacts K1:B from current overload. Diode D1 provides reverse polarity protection in the event power is inadvertently applied to SP1 and SP2 in a reverse polarity. Resistor R2 and zener diode D4 collectively function as a trickle charger in order to maintain a full charge on a rechargeable battery VBAT at preferably 12v. Power for the control circuit 500 is drawn from VBAT. The trickle charge sources the positive battery terminal SP3 of VBAT. The VBAT battery voltage is always available even in the event of failure of the main power source on SP1 and SP2, due to a collision of a vehicle or other power failure causing event.

The firing output SP13 is also electrically connected to auxiliary inputs SP11 and SP12, through current limiting resistor R1. Zener diode D3 maintains a constant voltage from source inputs SP11 and SP12. SP11 and SP12 may be connected, for example, to a temperature sensor 170 and an impact sensor 160, respectively, (see FIG. 1) to provide the necessary plus voltage to the firing output SP13 upon a fire or crash condition.

Termination connector J1 connects to an instrumentation panel housing 201, as shown, for example, in FIG. 1, where a power switch 210, or an audible alarm 207 and indicator lights 205 and 206 are mounted, connections to which are labeled on connector J1. The coil K1:A of relay K1 is electrically connected to the first common SW-COM1 of the switch 210 in a connector J1.

The switch 210 contains three positions: off, manual and automatic. When the switch is in the "off" position no power is supplied to SP1 and the fire extinguishing system is deactivated. When the switch is in the manual position, plus battery voltage, being constantly applied to the normally open manual terminal corresponding to COM1, is electrically connected to COM1 which in turn is electrically connected to K1:A, thereby energizing K1:A and firing the system as described above. The automatic terminal of the power switch is electrically connected to the first common COM1 when the power switch is in the automatic position, as is the normal position of the switch. While the switch is in this position, relay coil K1:A is electrically connected to: SP11 and SP12 through resistor R1, which allows the auxiliary inputs to fire the system as described above; terminal C2 of K1-B which maintains the relay in a latched energized state until power is removed; and diode D2 and R3 which pass an activation signal to K1:A from the pulse counting circuitry as described below. In addition, appropriate power is normally applied to the LED to illuminate green via the second common terminal COM2 when the system is not fired. The buzzer and the LED are electrically connected to the automatic terminal mentioned above, in order to energize the buzzer and illuminate the LED red when the system is automatically fired via the pulse counting circuitry as described below.

The balance of the components of FIG. 5 make up the pulse counting circuitry which, upon counting a predetermined number of pulses from the optical sensor within a predetermined time period, automatically fire the system. Pulses are received from the drive circuit via sensor SP7 and/or SP10 which are connected to transistor networks Q2 and Q3, respectively. The transistor networks which provide isolation to the sensor driver circuit have their outputs connected to a trigger TRIG input of a timer U1 and a clock input CLK of a first decade counter U2.

The timer U1 operates in a monostable mode. A suitable timer is Motorola MC 1455B. However, other embodiments may utilize different timers with similar functionality. The timer U1 is a monolithic timing circuit which uses an external resister R5 and capacitor C1 to set the predetermined time period according to the formula t=1.1 (R5)(C1) where it is the predetermined time period.

When the trigger input TRIG of timer U1 receives a first pulse from either of transistors Q2 or Q3, the timer activates in a monostable one-shot mode, thereby causing the output OUT of U1 to go to a high state for the predetermined time period. Subsequent pulses to TRIG will be ignored during this time period.

The output OUT of U1 is connected to the transistor network of Q1 and drives Q1 whose output is connected to the reset inputs RESET of U2 and U3. The output OUT of U1 remains in a high state during the predetermined time period, as described above, said high state being inverted via the Q1 transistor network, and received as a low sate at the reset inputs RESET of U2 and U3. When the predetermined time period expires the output OUT of U1 transitions to a low state until the next pulse is received by the trigger input of U1. When the output OUT of U1 transitions to the low state, the reset inputs RESET of U2 and U3 transition to a high state, thereby resetting both decade counters. However, during the predetermined time period, the reset inputs are activated in a low state, allowing the decade counters U2 and U3 to count pulses received from Q2 and Q3 on their clock input CLK. A suitable decade counter is available from Motorola under the designation MC74HC4017.

Decade counters U2 and U3 together with jumper block JB1 are in a cascaded configuration. Outputs 0 through 9 of decade counter U2 are consecutively activated for one clock period for a total of 10 clock periods where each clock period is equivalent to receiving a single pulse from transistor network Q1. So, for example, on pulse number 1, output 1 is in a high state and on pulse number 9, output 9 is in a high state, then the process returns to output 0 for pulse number 10. The last element in the cascaded configuration, decade counter U3 receives pulses on its clock CLK input from one of outputs 0 through 9 of U2, selectable via a jumper position on jumper block JB1. In this arrangement, one pulse is received at the clock input CLK of U3 for every ten pulses received on the clock input CLK of U2. The outputs 0 through 9 of U3 will each consecutively be in a high state for one pulse period after a period of 10 pulses is received from the driver circuit. Therefore, a predetermined number of pulses from 1 to 100 are selectable by receiving an output from decade Counter U3 which corresponds to the tens digit of the number of pulses and by setting the jumper on jumper block JB1 to a position corresponding to the ones digit in the number of pulses. For example, a desired predetermined number of pulses of 75 would require the jumper on JB1 to be in position 5, which connects terminals 11 and 12 on JB1, and the output 7 of U3 being connected to R3. One skilled in the art can select the minimum pulse count for activating the fire extinguishing system in accordance with the desired sensitivity of the system.

Once a predetermined pulse count has been selected as described above, preferably 50–75, an automatic output signal COUT is generated by the selected output of U3 whenever the minimum selected pulse count is reached in the time interval defined by the predetermined time period. However, if the predetermined time period set by timer U1 expires prior to reaching the predetermined pulse count, both decade counters U2 and U3 are reset and the cycle begins again on the next pulse. The automatic output signal COUT will not be generated by U3 in such a case. Only when the predetermined number of pulses are received within the predetermined time period will an automatic output be generated by U3. Thus, circuit 500 of the control system 200 periodically determines a pulse rate and, if the pulse rate exceeds a predetermined value, the control system responsively supplies electric current to the firing assembly.

The automatic output signal COUT, as selected on U3, is electrically connected to K1:A through resistor R3 and diode D2, which serve to isolate counter U3 from the auxiliary inputs SP11 and SPl2. The automatic output signal COUT energizes K1:A which activates the fire extinguishing system as described above.

Figure 4:
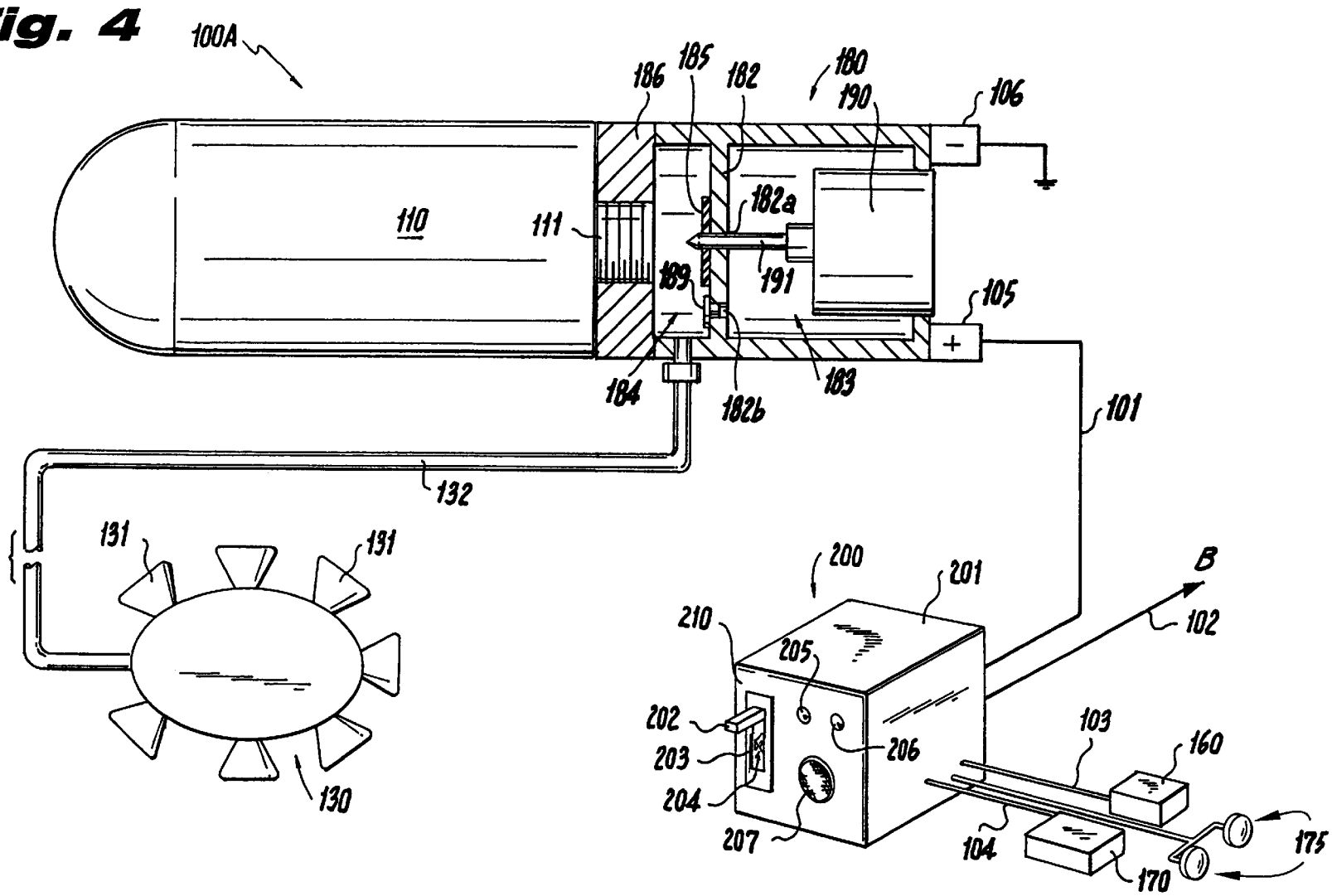
FIG. 4 is an alternative embodiment of the invention employing a solenoid firing system.

Referring now to FIG. 4, an alternative embodiment 100A of the fire extinguishing system is similar to embodiment 100 shown in FIG. 1 except that alternative embodiment 100A employs a solenoid driven firing assembly 180.

More particularly firing assembly 180 includes housing 181 having a retainer plate 182 which divides the housing interior into first and second chambers 183 and 184, respectively. An electrically powered propelling means includes solenoid 190, which is mounted at a proximal end of housing 181 and includes a linearly movable firing pin 191 which extends distally from the solenoid along the axis of the firing assembly 180. Solenoids suitable for use in the present invention are conventional and known to those with skill in the art. The firing pin is slidably disposed through aperture 182*a* in the retainer plate. Firing pin 191 is also disposed through an aperture in sealing material 185. The sheet of sealing material 185, such as rubber, is annularly disposed around aperture 182*a* on the distal side of retainer plate 182 and inhibits the flow of gas through aperture 182*a*. Housing 181 further includes a distal mounting plate 186 having a threaded aperture 187 adapted to receive sealed outlet portion 111 of the cartridge 110. Thus, cartridge 110 can be removably joined with the firing assembly 180 by screw type engagement. Alternatively, a bayonet type mounting engagement may be used.

Retainer plate 182 preferably also includes a second aperture 182*b* having a diameter of from about 1/32 inch to about 1/8 inch, preferably about 1/16 inch. Optionally, a check valve 189 is positioned in conjunction with aperture 182*b* to permit passage of gas distally through aperture 182*b* (i.e., from first chamber 183 to second chamber 184) in the event of a buildup of excess pressure in first chamber 183. The check valve 189 is preferably similar in construction and function to check valve 135 described above.

When the solenoid 190 is activated by electrical current conveyed along line 101, the firing pin 191 is distally advanced with force sufficient to pierce the seal of sealed outlet portion 111. The fire extinguishing agent and/or propellant is released into second chamber 184 and, from there, into discharge duct 132. The fire extinguishing agent is then conveyed to discharge chamber 130 whereupon it exits the system through one or more nozzles 131. Control system 200, containing the circuitry shown in FIG. 3 or FIG. 5, controls functioning of the fire extinguishing system, as described above.

Figure 6:
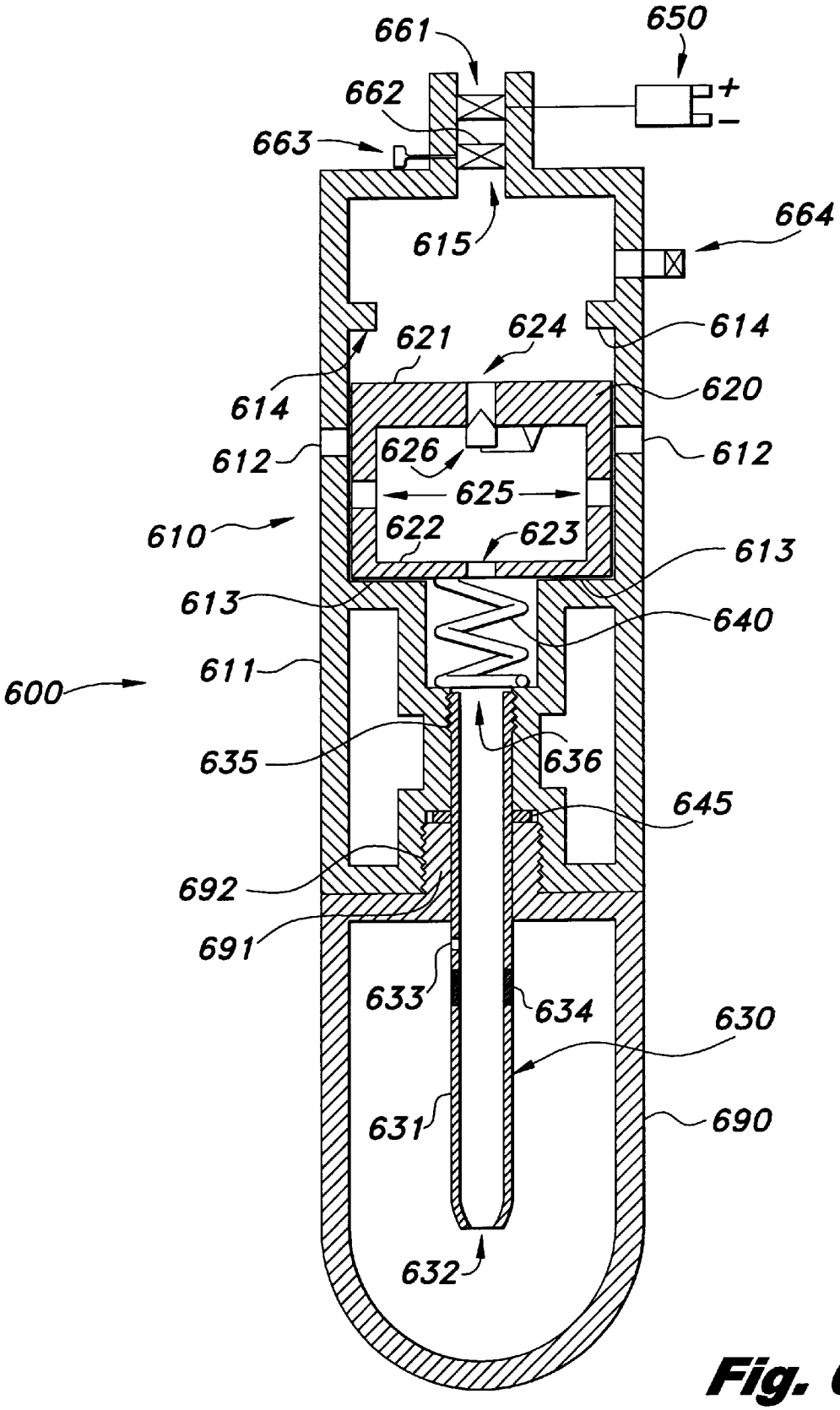
FIGS. 6 and 7 are diagrammatic views illustrating an electropneumatic system for the release of a fire extinguishing agent.
Figure 7:
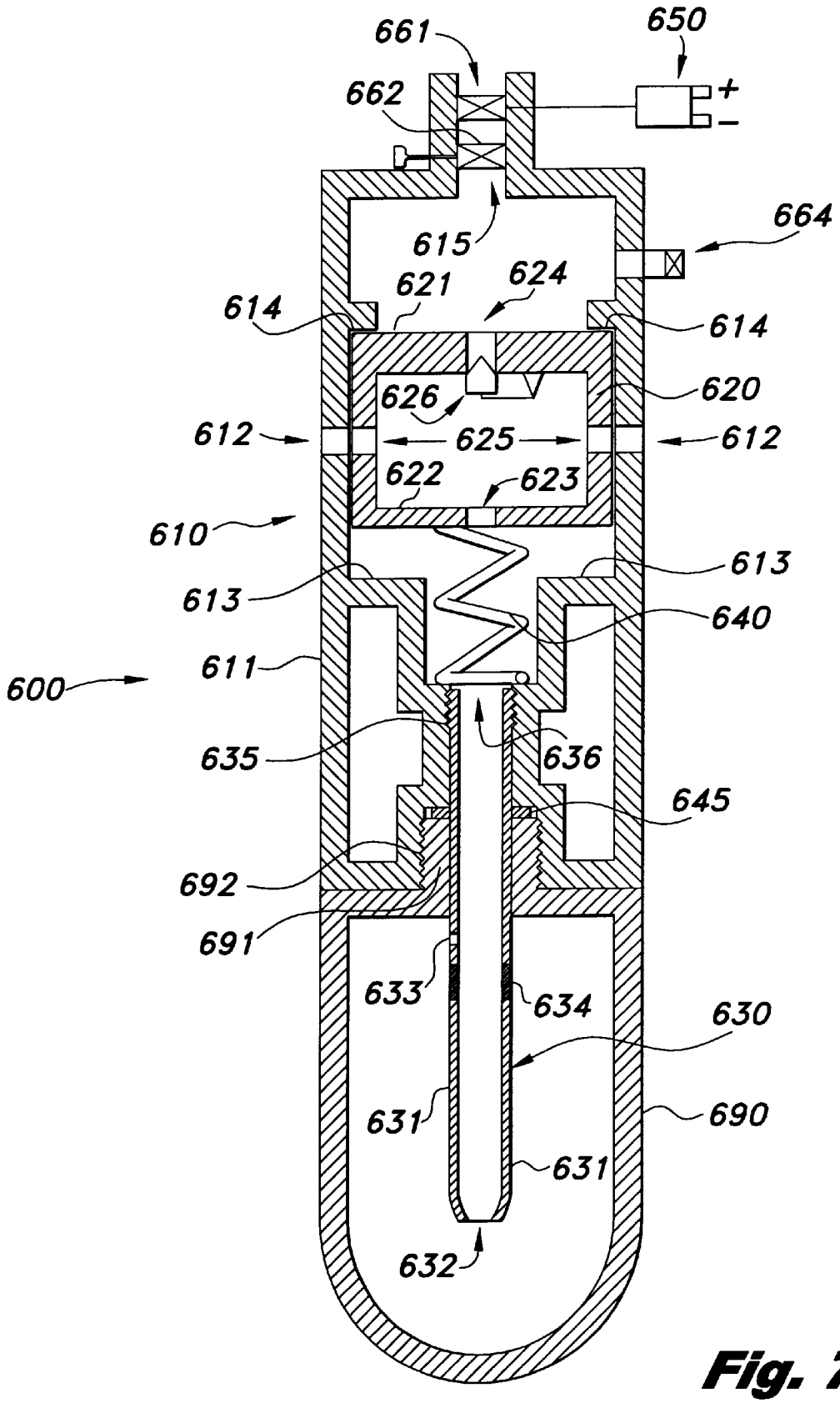

Referring now to FIGS. 6 and 7, a fire extinguishing system 600 is illustrated which employs an electropneumatic firing assembly 610, which may alternatively be used in place of firing assembly 180 or 120 in conjunction with ducts 132 and discharge chamber 130, and control assembly 200 with electronic control circuitry as shown in FIGS. 3 or 5. Firing assembly 610 is driven by a solenoid 650 which operates valve 661, as explained below, and is connected to a container 690 of fire extinguishing agent.

More particularly, firing assembly 610 includes a generally cylindrical body portion 611 having outlet apertures 612 which lead to a duct (not shown) for conveying fire extinguishing agent to a discharge chamber and/or nozzles, such as chamber 130 and nozzles 131 shown in FIG. 1. At a proximal first end the firing assembly body portion 611 includes an inlet/outlet port 615 in which are positioned two valves: an automatic solenoid controlled dump valve 661 which is opened in response to activation of solenoid 650, and a manually operated valve 662 which is opened or closed by operation of a handle 663. The solenoid 650 is commercially available from various sources, such as Asco Co. The valves are commercially available from various sources such as, for example, Angar Co. The valves preferably should be capable of operating properly at pressures of up to about 3,000 psi. Optionally, a pressure gauge (not shown) may be included to visually display the internal pressure of the firing assembly 610. A supplemental charging port having a one way valve 664 may optionally also be included in the firing assembly 610.

At a distal second end of the firing assembly body portion 611 is an opening in which the mouth portion 691 of fire agent container 690 is secured by threaded screw-in engagement 692. A tube 630 extends into the fire agent container 690 and is secured at an open proximal end 636 to the interior of firing assembly 610 by means of a threaded screw-in engagement 635. Tube 630 comprises a relatively flexible portion 634 disposed between relatively stiff or rigid portions 631. Stiff portion 631 can be, for example a metal or rigid plastic material. Flexible portion 634 can be, for example, a natural or synthetic rubber, or a flexible plastic material, and provides for flexing of the tube 630 at that position. Tube 630 also includes a side aperture 633 and a distal opening 632.

In the interior of firing assembly body portion 611 is a piston relief valve 620 which is axially movable between proximal stop surface 614 and distal stop surface 613. Piston relief valve is resiliently biased to the distal position by means of a coiled expansion spring 640 attached at one end to the distal surface 622 of piston relief valve 620 and at the other end to an interior surface of the firing assembly body portion 611. Piston relief valve 620 includes a hollow interior space, a proximal axial aperture 624, a distal axial aperture and lateral apertures 625 positioned so as to align with apertures 612 of the firing assembly body portion 611 when the piston relief valve is in the proximal position. A check valve 626 allows the distal passage of charging gas through proximal aperture 624, but not the proximal passage of gas therethrough.

Fire extinguishing system 600 operates in the following manner. Tube 630 is attached to the firing assembly body 611 and a fire agent container 690 is attached to the firing assembly body 611 by screwing in the mouth portion 691 into the distal end of the firing assembly body. An O-ring 645 can be used to insure a more secure gaseous seal. The fire agent container 690 may initially contain a fire agent such as ABC powder, or a fluid agent (e.g., halohydrocarbons. Alternatively, the charging gas (e.g., nitrogen, carbon dioxide, etc.) can itself be employed as the fire agent, and introduced into container 690 as will now be explained. The charging gas is introduced under pressure (e.g., up to 3,000 psi) either through one way valve 664, or through proximal opening 615 with valves 662 and 661 in the open position. The gas will flow distally through apertures 624, 623 and through distal outlet 632 and/or lateral aperture 633 of tube 630, until the pressure is equalized within the fire agent container 690 and the interior of the firing assembly 610. The fully pressurized fire extinguishing system 600 may be disarmed by manual closure of valve 662, for example, if the firing assembly 610 needs to be removed or examined for maintenance to prevent accidental firing. When manual valve 662 is in the open position the firing assembly 610 is ready for operation.

In the event that solenoid 650 receives a firing signal from the control circuitry, valve 661 will be opened and gas proximal to the piston relief valve 620 will be dumped, thereby reducing pressure proximal to the relief valve. The higher distal pressure will then move the piston relief valve 620 proximally against the biasing force of spring 640 until proximal surface 621 abuts stop surface 614, as shown in FIG. 7. In the proximal position of the piston relief valve 620, lateral apertures 625 align with apertures 612 of the firing assembly body 611, thereby permitting release of the pressurized fire agent therethrough into a discharge duct. When the pressure has been released the piston relief valve 620 is returned to the distal position by the resilient biasing force of spring 640.

While the above description contains many specifics, these specifics should not be construed as limitations on the scope of the invention, but merely as exemplifications of preferred embodiments thereof. Those skilled in the art will envision many other possible variations that are within the scope and spirit of the invention as defined by the claims appended hereto.

What is claimed is:

1. A fire extinguishing system which comprises:

a) a firing assembly for mounting to a container of pressurized fire extinguishing agent, the firing assembly including firing means responsive to an electric current for releasing the fire extinguishing agent from the container;

b) an optical flame detector for generating a signal in response to receiving radiation from a flame, wherein the optical flame detector is responsive to ultraviolet radiation having a wavelength of from about 180 nanometers to no more than about 280 nanometers; and c) a control system for supplying the electric current to the firing means, the control system being responsive to the signal of the optical flame detector and having a manual control switch.

2. The fire extinguishing system of claim 1 wherein the optical flame detector generates a signal comprising a series of electric pulses, and the control system includes an electronic timer and a pulse counter for counting the pulses of the signal received with a predetermined period of time to determine a detected pulse frequency, wherein the control system supplies the electric current to the firing means if the detected pulse rate exceeds a predetermined value of the pulse frequency.

3. The fire extinguishing system of claim 2 wherein the pulse frequency of the optical flame detector signal corresponds to the intensity of the radiation received from the flame.

4. The fire extinguishing system of claim 2 wherein the optical flame detector is responsive to ultraviolet radiation having a wavelength of from about 185 to 260 nanometers in wavelength.

5. The fire extinguishing system of claim 1 further including an impact sensor.

6. The fire extinguishing system of claim 1 further including a temperature sensor.

7. The fire extinguishing system of claim 1 wherein the container of pressurized fire extinguishing agent includes an outlet with a puncturable seal, and the firing assembly includes a housing having an interior space, wherein the firing means includes a slidable member positioned in the interior of the housing and movable between a proximal position and a distal position for puncturing the seal.

8. The fire extinguishing system of claim 7 wherein the firing means includes an explosive squib for propelling the slidable member distally in respons to ignition by means of the electric current.

9. A fire extinguishing system which comprises:

a) a firing assembly for mounting to a container of pressurized fire extinguishing agent, the firing assembly including firing means responsive to an electric current for releasing the fire extinguishing agent from the container, wherein the firing means includes a solenoid for distally advancing a slidable member in response to application thereto of the electric current;

b) an optical flame detector for generating a signal in response to receiving radiation from a flame; and c) a control system for supplying the electric current to the firing means, the control system being responsive to the signal of the optical flame detector and having a manual control switch.

10. The fire extinguishing system of claim 9 wherein the optical flame detector is responsive to ultraviolet radiation having a wavelength below 300 nanometers.

11. The fire extinguishing system of claim 9 wherein the optical flame detector is responsive to ultraviolet radiation having a wavelength of from about 180 to no more than about 280 nanometers.

12. A fire extinguishing system which comprises:

a) a firing assembly for mounting to a container of pressurized fire extinguishing agent, the firing assembly including firing means responsive to an electric current for releasing the fire extinguishing agent from the container, wherein the firing assembly includes a housing having an interior space and a piston valve slidably mounted in the interior of the housing and movable between a distal position and a proximal position;

b) an optical flame detector for generating a signal in response to receiving radiation from a flame; and c) a control system for supplying the electric current to the firing means, the control system being responsive to the signal of the optical flame detector and having a manual control switch.

13. The fire extinguishing system of claim 12 wherein the housing includes a proximal end having a first opening communicating with a proximal portion of the interior space proximal to the piston valve.

14. The fire extinguishing system of claim 13 wherein the piston valve includes a proximal wall having an opening for permitting the distal flow of gas from the proximal portion of the interior space of the housing to an interior chamber in the piston, wherein the piston valve includes a check valve for permitting the distal flow of gas through said opening in the proximal wall of the piston valve but restricting the proximal flow of gas therethrough.

15. The fire extinguishing system of claim 14 wherein the piston valve includes a distal wall having a distal opening for equalizing gas pressure between the interior chamber of the piston and the container.

16. The fire extinguishing system of claim 15 wherein the piston valve includes a side wall having at least one lateral opening and the housing includes at least one exhaust port such that when the lateral opening and the exahaust port become aligned in response to movement from the piston valve from the distal position to the proximal position.

17. The fire extinguishing system of claim 16 wherein the first opening of the housing includes a release valve for controlling the flow of gas herethough.

18. The fire extinguishing system of claim 17 wherein said release valve includes a solenoid which moves the release valve into an open position in response to the electric current to release gas from the proximal portion of the interior space of the housing.

19. The fire extinguishing system of claim 18 wherein piston valve moves from the distal position to the proximal position in response to release of gas from the proximal space of the interior chamber.

20. The fire extinguishing system of claim 19 wherein the piston valve is resiliently biased to the distal configuration by means of a spring.

* * * * *